US011661785B2

(12) United States Patent
Chatziioannou

(10) Patent No.: US 11,661,785 B2
(45) Date of Patent: May 30, 2023

(54) HANDLING OF REMOTELY TRIGGERED OPERATION OF A VEHICLE DOOR

(71) Applicant: Volvo Car Corporation, Gothenburg (SE)

(72) Inventor: Kostas Chatziioannou, Gothenburg (SE)

(73) Assignee: Volvo Car Corporation, Gothenburg (SE)

( * ) Notice: Subject to any disclaimer, the term of this patent is extended or adjusted under 35 U.S.C. 154(b) by 525 days.

(21) Appl. No.: 16/778,138

(22) Filed: Jan. 31, 2020

(65) Prior Publication Data

US 2020/0248497 A1 Aug. 6, 2020

(30) Foreign Application Priority Data

Feb. 5, 2019 (EP) ..... 19155584

(51) Int. Cl.
*E05F 15/00* (2015.01)
*E05F 15/73* (2015.01)

(52) U.S. Cl.
CPC ..... *E05F 15/73* (2015.01); *E05Y 2900/531* (2013.01)

(58) Field of Classification Search
CPC . E05F 15/73; E05F 15/75; E05F 17/00; E05F 15/70; E05Y 2900/531; E05Y 2900/50; E05Y 2900/00
USPC ..... 49/31; 701/2
See application file for complete search history.

(56) References Cited

U.S. PATENT DOCUMENTS 7,778,743 B2 * 8/2010 Arie ..... B60R 25/403 340/426.36
9,836,892 B1 * 12/2017 Nishiyama ..... E05B 81/04
10,160,420 B2 * 12/2018 Tomita ..... B60R 25/2081
(Continued)

FOREIGN PATENT DOCUMENTS

CN 103670121 A 3/2014
CN 104234574 A 12/2014
(Continued)

OTHER PUBLICATIONS

Response to Extended Search Report dated Jul. 23, 2019, from counterpart European Application No. 19155584.6 filed Aug. 18, 2020, 4 pp.
(Continued)

*Primary Examiner* — Chi Q Nguyen
(74) *Attorney, Agent, or Firm* — Shumaker & Sieffert, P.A.

(57) ABSTRACT

A door assist system of a vehicle may handle a remotely triggered operation of a power door of the vehicle. The door assist system receives from an off-board system a door closure signal requesting the door assist system to activate closing of a power door of the vehicle. The door assist system further determines with input from one or more surroundings detecting sensors adapted to capture a surrounding proximate the vehicle, that an obstacle is in vicinity of the vehicle. Moreover, the door assist system refrains from activating closing of the power door when the obstacle is determined to interfere and/or potentially interfere with a projected closing path of the power door. A door assist system, and a vehicle comprising such a door assist system may perform the foregoing remotely triggered operation.

8 Claims, 3 Drawing Sheets

(56) References Cited

U.S. PATENT DOCUMENTS

| | | | | |
|---|---|---|---|---|
| 2007/0296242 | A1* | 12/2007 | Frommer | E05F 15/616 296/146.4 |
| 2009/0139142 | A1* | 6/2009 | Li | E05F 15/73 49/25 |
| 2013/0097940 | A1* | 4/2013 | Brown | E05F 15/605 49/506 |
| 2014/0365079 | A1 | 12/2014 | Kaiser et al. | |
| 2015/0283886 | A1 | 10/2015 | Nania | |
| 2017/0030135 | A1 | 2/2017 | Elie et al. | |
| 2017/0249797 | A1 | 8/2017 | Elie et al. | |
| 2017/0292313 | A1 | 10/2017 | Herman et al. | |
| 2018/0291666 | A1* | 10/2018 | Linden | E05F 15/611 |
| 2018/0321758 | A1* | 11/2018 | Serban | E06B 7/36 |
| 2019/0010750 | A1* | 1/2019 | Scanu | E05B 51/00 |
| 2019/0047511 | A1* | 2/2019 | Link, II | G07C 9/00309 |
| 2019/0100949 | A1* | 4/2019 | Aravkin | E05C 17/006 |
| 2019/0112849 | A1* | 4/2019 | Cumbo | E05C 17/003 |
| 2019/0153768 | A1* | 5/2019 | Termine | E05F 15/622 |

FOREIGN PATENT DOCUMENTS

| | | | |
|---|---|---|---|
| CN | 104975781 | A | 10/2015 |
| CN | 106401366 | A | 2/2017 |
| CN | 107451851 | A | 12/2017 |
| CN | 108602466 | A | 9/2018 |
| WO | 2016173579 | A1 | 11/2016 |
| WO | 2017132143 | A1 | 8/2018 |

OTHER PUBLICATIONS

European Search Report issued in European Application No. 19155584.6 completed Jul. 23, 2019, 2 pp.

* cited by examiner

HANDLING OF REMOTELY TRIGGERED OPERATION OF A VEHICLE DOOR

CROSS REFERENCE

This application claims priority to European Application No. 19155584.6 filed Feb. 5, 2019, the entire contents of which are hereby incorporated by reference.

TECHNICAL FIELD

The present disclosure relates to handling of remotely triggered operation of a power door of a vehicle.

BACKGROUND

In a not too distant future, driverless taxis may be a reality. Eliminating the need for a human chauffeur, which represents a significant part of the operating cost for taxi services, could make it an affordable solution for the customers, and further accelerate the spreading of e.g. Transportation-as-a-Service (TaaS) solutions as opposed to individual car ownership.

With driverless taxis, however, challenges arise which are non-present for conventional chauffeur-driven taxis. One such challenge is the potential scenario of a customer i.e. passenger after departing the driverless taxi, leaving a vehicle door left open. With an unclosed vehicle door, the driverless taxi may e.g. be unable to take off and/or the taxi service for said customer may be prevented from being deemed completed.

US20170292313 A1, for instance, discloses how an autonomous vehicle may transport users without a human operator in exchange for a fare. However, although US20170292313 A1 suggests improvements when it comes to closing of a vehicle power door and subsequently determining that a ride is completed, there is still room for improvements and/or alternative solutions when it comes to handling of a vehicle power door.

SUMMARY OF THE INVENTION

It is therefore an object of embodiments herein to provide an approach for handling remotely triggered operation of a vehicle power door in an improved and/or alternative manner.

According to a first aspect of embodiments herein, the object is achieved by a method performed by a door assist system of a vehicle for handling of remotely triggered operation of a power door of the vehicle. The door assist system receives from an off-board system a door closure signal requesting the door assist system to activate closing of a power door of the vehicle. The door assist system further determines with input from one or more surroundings detecting sensors adapted to capture a surrounding proximate the vehicle, that an obstacle is in vicinity of the vehicle. Moreover, the door assist system refrains from activating closing of the power door when the obstacle is determined to interfere and/or potentially interfere with a projected closing path of the power door.

According to a second aspect of embodiments herein, the object is achieved by a door assist system of a vehicle for—and/or adapted for—handling of remotely triggered operation of a power door of the vehicle. The door assist system comprises a closing request receiving unit for—and/or adapted for—receiving from an off-board system a door closure signal requesting the door assist system to activate closing of a power door of the vehicle. The door assist system further comprises an obstacle determining unit for—and/or adapted for—determining with input from one or more surroundings detecting sensors adapted to capture a surrounding proximate the vehicle, that an obstacle is in vicinity of the vehicle. Moreover, the door assist system comprises a closing refraining unit for—and/or adapted for—refraining from activating closing of the power door when the obstacle is determined to interfere and/or potentially interfere with a projected closing path of the power door.

According to a third aspect of embodiments herein, the object is achieved by a vehicle comprising the discussed door assist system.

According to a fourth aspect of embodiments herein, the object is achieved by a computer program product comprising a computer program containing computer program code means arranged to cause a computer or a processor to execute the steps of the discussed door assist system, stored on a computer-readable medium or a carrier wave.

Thereby, there is introduced an approach according to which measures are provided to meet off-board triggered operation of a vehicle power door, for instance of a passenger door of a driverless taxi. That is, since there may be received from an off-board system a door closure signal requesting the door assist system to activate closing of a power door of the vehicle, the door assist system may be instructed by a source located remotely from the vehicle, to actuate closing of a power door of said vehicle. Accordingly, closing of a vehicle power door may be initiated from a system not comprised in the vehicle, such as for instance from a service centre for managing driverless taxis. Moreover, that is, since it may be determined with input from one or more surroundings detecting sensors adapted to capture a surrounding proximate the vehicle that an obstacle is in vicinity of the vehicle, it may be established with support from at least a first sensor capturing a surrounding outside the vehicle that an obstacle is proximate the vehicle. Accordingly, a check may be carried out of whether there is an obstacle nearby the vehicle. Furthermore, since the door assist system may refrain from activating closing of the power door when the obstacle is determined to interfere and/or potentially interfere with a projected closing path of the power door, upon determining that an obstacle is or is about to become in the way for the intended closing of the power door, the door assist system may refrain from actuating the requested closing of said power door. Accordingly, a check may be carried out of whether a detected obstacle is deemed to interfere and/or potentially interfere with a projected closing path, and when that is the case, the—by the off-board system requested—closing of the power door is not actuated and/or alternatively held e.g. until it is determined that the obstacle no longer interferes and/or potentially interferes with the projected closing path of the power door. Thus, the risk of the power door upon the requested closing colliding with and/or hitting an obstacle, and/or the risk of pinching said obstacle between the power door and the vehicle, is thereby eliminated and/or at least reduced.

For that reason, an approach is provided for in an improved and/or alternative manner handle remotely triggered operation of a vehicle power door.

The technical features and corresponding advantages of the above mentioned method will be discussed in further detail in the following.

BRIEF DESCRIPTION OF THE DRAWINGS

The various aspects of the non-limiting embodiments, including particular features and advantages, will be readily understood from the following detailed description and the accompanying drawings, in which.

DETAILED DESCRIPTION

Figure 1:
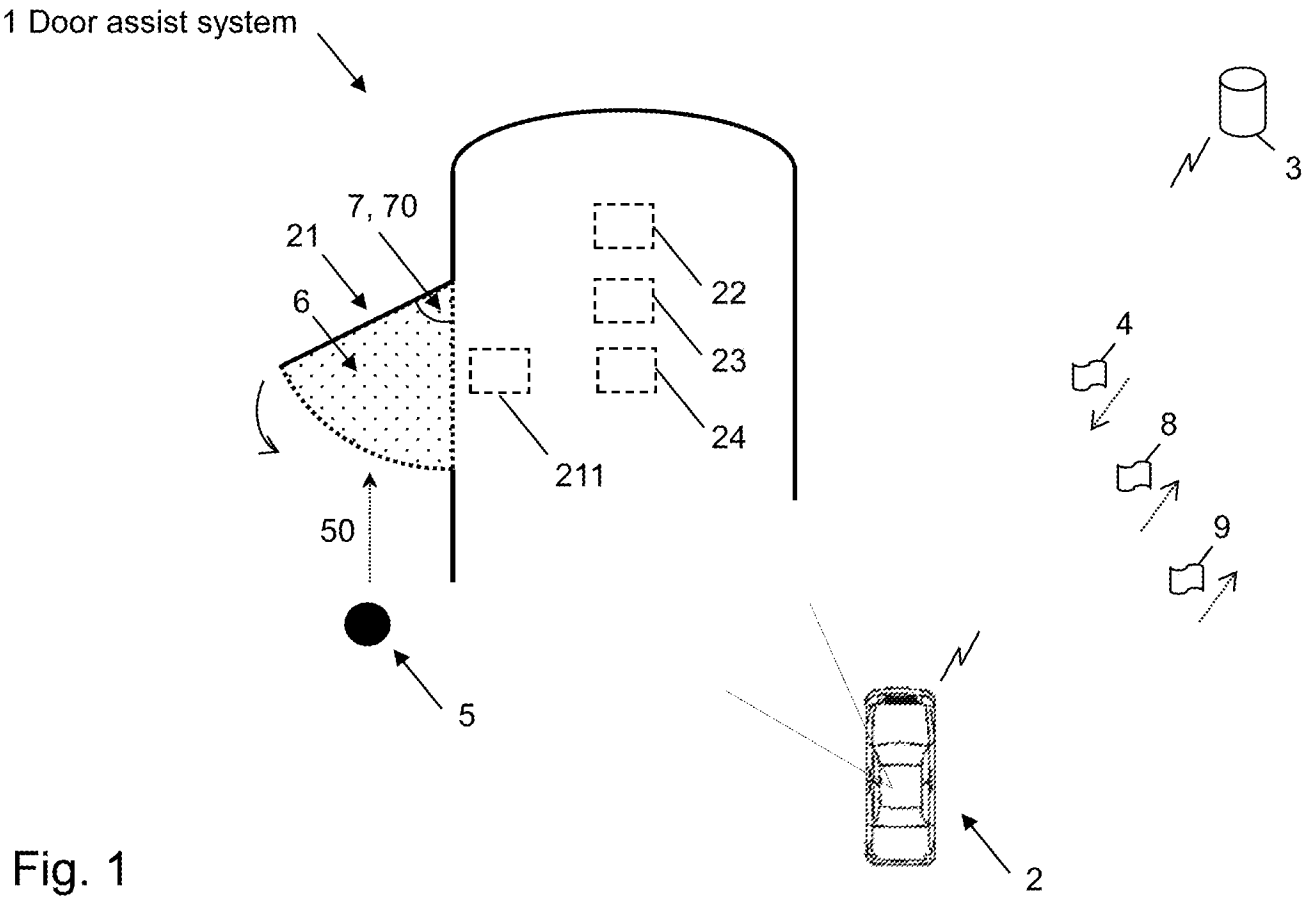
FIG. 1 illustrates a schematic view of an exemplifying door assist system of a vehicle according to embodiments of the disclosure.

Non-limiting embodiments of the present disclosure will now be described more fully hereinafter with reference to the accompanying drawings, in which currently preferred embodiments of the disclosure are shown. This disclosure may, however, be embodied in many different forms and should not be construed as limited to the embodiments set forth herein. Like reference characters refer to like elements throughout. Dashed lines of some boxes in the figures indicate that these units or actions are optional and not mandatory.

In the following, according to embodiments herein which relate to handling of remotely triggered operation of a power door of a vehicle, there will be disclosed an approach according to which measures are provided to meet off-board triggered operation of a vehicle power door.

Referring now to the figures and FIG. 1 in particular, there is depicted a schematic view of an exemplifying door assist system 1 of a vehicle 2 according to embodiments of the disclosure. The door assist system 1 is adapted for handling of remotely triggered operation of a power door 21 of the vehicle 2. The exemplifying vehicle 2 may for instance be represented by a driverless taxi. The exemplifying power door 21, on the other hand, may refer to any one power door of said vehicle 2, such as a passenger door.

The expression "door assist system" may refer to "vehicle power door assist system" and/or "door closing refraining system", whereas "of" a vehicle may refer to "comprised" in a vehicle. The referred to "vehicle" may be represented by any arbitrary vehicle, for instance an engine-propelled vehicle, such as e.g. a car, truck, lorry, van, tractor and/or bus. "Vehicle" may further refer to "autonomous and/or at least partly autonomous vehicle", "driverless and/or at least partly driverless vehicle", "self-driving and/or at least partly self-driving vehicle", and according to an example further to "taxi" and/or "robo(t)-taxi". "For" handling of remotely triggered operation may refer to "adapted for" handling of remotely triggered operation, whereas "for handling of" remotely triggered operation may refer to "for managing of" and/or "to take measure to meet a" remotely triggered operation. "Remotely" triggered operation, on the other hand, may refer to "off-board", "wirelessly" and/or "a reservation centre and/or service centre" triggered operation, and according to an example further to "a handheld electronic device, user electronic device, smart watch, smartphone and/or key fob" triggered operation. "'Triggered" may refer to "initiated". The expression "operation" of a power door may refer to "closing" of a power door, whereas "power door" may refer to "power operated door", "motorized door" and/or merely "door". The referred to "power door" may refer to any arbitrary power door commonly known in the art, which may be opened and/or closed in a known manner by means of e.g. one or more actuators and/or one or more motors. The referred to "power door" may according to an example further refer to "passenger power door", "outwardly swinging power door" and/or "side power door". According to an example, the expression "for handling of remotely triggered operation of a power door of the vehicle" may refer to "for handling of remotely triggered operation of a power door of the vehicle, the door assist system being adapted for activating closing of the power door".

The door assist system 1 is—by means of a closing request receiving unit 105 (shown in FIG. 2)—adapted for receiving from an off-board system 3 a door closure signal 4 requesting the door assist system 1 to activate closing of a power door 21 of the vehicle 2. Thereby, the door assist system 1 may be instructed by a source 3 located remotely from the vehicle 2, to actuate closing of a power door 21 of said vehicle 2. Accordingly, closing of a vehicle power door 21 may be initiated from a system 3 not comprised in the vehicle 2 itself.

The exemplifying off-board system 3 may for instance be part of a service centre for managing self-driving taxis, for instance distributed among one or more servers. Communication between the door assist system 1 and the off-board system 3 may be accomplished as commonly known in the art, for instance by communicating wirelessly in a known manner. Potential closing of the power door 21, on the other hand, may for instance be accomplished with support from an exemplifying power door subsystem 211, for instance comprising one or more e.g. commonly known actuators 2111 (shown in FIG. 2) and/or one or more e.g. commonly known motors 2112 (shown in FIG. 2) enabling closing of the power door 21 in a known manner.

The expression "off-board system" may refer to "remote system", "system not comprised in the vehicle" and/or "wirelessly connected system". According to an example, "off-board system" may refer to "off-board system supporting communication with one or more vehicles", and according to another example, to "handheld electronic device, user electronic device, smart watch and/or key fob adapted to communicate with the vehicle". Moreover, "system" may refer to "vehicles management system", "control system", "back-end system", "one or more automotive clouds and/or cloud networks adapted for cloud-based storage" and/or "at least a first server". The referred to "off-board system" may be adapted to wirelessly communicate with, and/or adapted to be wirelessly in connection with, the door assist system. The expression door closure "signal" may refer to door closure "message", "request" and/or "instruction", whereas "requesting" the door assist system may refer to "prompting" and/or "instructing" the door assist system. "Activate" closing, on the other hand, may refer to "actuate", "initiate" and/or "enable" closing, whereas "closing" may refer to "bringing the power door to a pre-latched, semi-latched, secondary latched, fully latched and/or fully closed state and/or position". According to an example, the expression "to activate closing of a power door of the vehicle" may refer to "to activate closing of a power door of the vehicle with support from a power door subsystem comprising one or more actuators and/or one or more motors enabling closing of the power door".

The door assist system 1 is—by means of an obstacle determining unit 106 (shown in FIG. 2) —adapted for determining with input from one or more surroundings detecting sensors 22 adapted to capture a surrounding proximate the vehicle 2, that an obstacle 5 is in vicinity of the vehicle 2. Thereby, it may be established with support from at least a first sensor 22 sensing a surrounding outside the vehicle 2 that an obstacle 5 is proximate the vehicle 2. In other words, a check may be carried out of whether there is an obstacle near the vehicle 2.

Determining that an obstacle 5 is in vicinity of the vehicle 2 may be accomplished as commonly known in the art, and accordingly, the one or more surroundings detecting sensors 22 may refer to commonly known sensors adapted to capture a surrounding proximate the vehicle 2, such as e.g. one or more cameras, radars, LIDARs etc. The one or more surrounding detecting sensors 22 may be positioned in any arbitrary manner considered relevant to capture a surrounding—and/or at least a portion of a surrounding—proximate the vehicle 2, and for instance be comprised in and/or be attached to the vehicle 2. The exemplifying obstacle 5 may for instance be represented by a road user, pedestrian and/or passenger, e.g. standing next to, moving towards and/or moving around the vehicle 2.

The expression "with input" from one or more surrounding detecting sensors may refer to "with support" from one or more surrounding detecting sensors, whereas "surroundings" detecting sensors may refer to "environment" detecting sensors. Adapted to "capture" a surrounding may refer to adapted to "sense" a surrounding. The expression "surrounding" proximate the vehicle, on the other hand, may refer to "at least a portion of a surrounding" and/or "external environment" proximate the vehicle, whereas "proximate" the vehicle may refer to "proximate one or more power doors of" the vehicle. Moreover, "proximate" the vehicle may refer to "proximate and external" the vehicle, and according to an example further to "in vicinity of", "nearby" and/or "at least within a predetermined and/or predeterminable distance from" the vehicle, such as for instance "at least within 1 metre, more preferred at least within 5 metres, and most preferred at least within 10 metres from" the vehicle. "Obstacle", on the other hand, may refer to "object" and/or "human being", and may for instance refer to a passenger, pedestrian, cyclist, motorcyclist, road user, etc. The expression "in vicinity of" the vehicle may refer to "near", "proximate" and/or "within a predetermined and/or predeterminable distance from" the vehicle, such as for instance "within 1, 5 and/or 10 metres from" the vehicle. According to an example, the expression "that an obstacle is in vicinity of the vehicle" may refer to "whether an obstacle is in vicinity of the vehicle".

The door assist system 1 is—by means of a closing refraining unit 109 (shown in FIG. 2)—adapted for refraining from activating closing of the power door 21 when the obstacle 5 is determined to interfere and/or potentially interfere with a projected closing path 6 of the power door 21. Thereby, upon determining that an obstacle 5 is or is about to become in the way for the intended closing of the power door 21, the door assist system 1 may refrain from actuating the requested closing of said power door 21. In other words, a check may be carried out of whether a detected obstacle 5 is deemed to interfere and/or potentially interfere with a projected closing path 6, and when that is the case, the—by the off-board system 3 requested—closing of the power door 21 is not actuated or alternatively held e.g. until it is determined that the obstacle 5 no longer interferes and/or potentially interferes with the projected closing path 6 of the power door 21. Thus, the risk of the power door 21 upon the requested closing colliding with and/or hitting an obstacle 5, and/or the risk of pinching said obstacle 5 between the power door 21 and the vehicle 2, may thereby be eliminated and/or at least reduced.

Determining that the obstacle 5 interferes and/or potentially may interfere with the projected closing path 6 may be accomplished e.g. by analysing a position and/or an expected position of the obstacle, and comparing with the projected closing path 6.

The expression "refraining from" activating closing may refer to "holding" activating closing, whereas "activating" closing may refer to "actuating" and/or "enabling" closing. "Activating closing of the power door", on the other hand, may refer to "activating closing of the power door by sending a closing signal and/or message to the power door and/or a control unit associated therewith". "When" may refer to "if", whereas "determined" to interfere may refer to "predicted", "analysed" and/or "calculated" to interfere. The expression "interfere and/or potentially interfere with" a projected closing path may refer to "be in the way of or potentially be in the way of" a projected closing path and/or "have a position and/or a predicted position within" a projected closing path, whereas "potentially" interfere may refer to "is predicted to" interfere. "Projected" closing path, on the other hand, may refer to "expected", "determined" and/or "calculated" closing path, whereas "closing path" may refer to "inner swing path" and/or "closing path area and/or space between an open position of the power door and a closed positon of the power door". According to an example, the expression "refraining from activating closing of the power door when the obstacle is determined to interfere and/or potentially interfere with a projected closing path of the power door" may refer to "refraining from activating closing of the power door when the obstacle is determined to interfere and/or potentially interfere with a projected closing path of the power door as the power door moves from an open position to a closed position". According to another example, the expression "refraining from activating closing of the power door when the obstacle is determined to interfere and/or potentially interfere with a projected closing path of the power door" may refer to "refraining from activating closing of the power door when the obstacle is determined to interfere and/or potentially interfere with a projected closing path of the power door, and otherwise activating closing of the power door". According to yet another example, the expression "refraining from activating closing of the power door when the obstacle is determined to interfere and/or potentially interfere with a projected closing path of the power door" may refer to "refraining from activating closing of the power door when the obstacle is determined to interfere and/or potentially interfere with a projected closing path of the power door, until it is determined that the obstacle no longer interferes and/or potentially interferes with the projected closing path of the power door".

Figure 2:
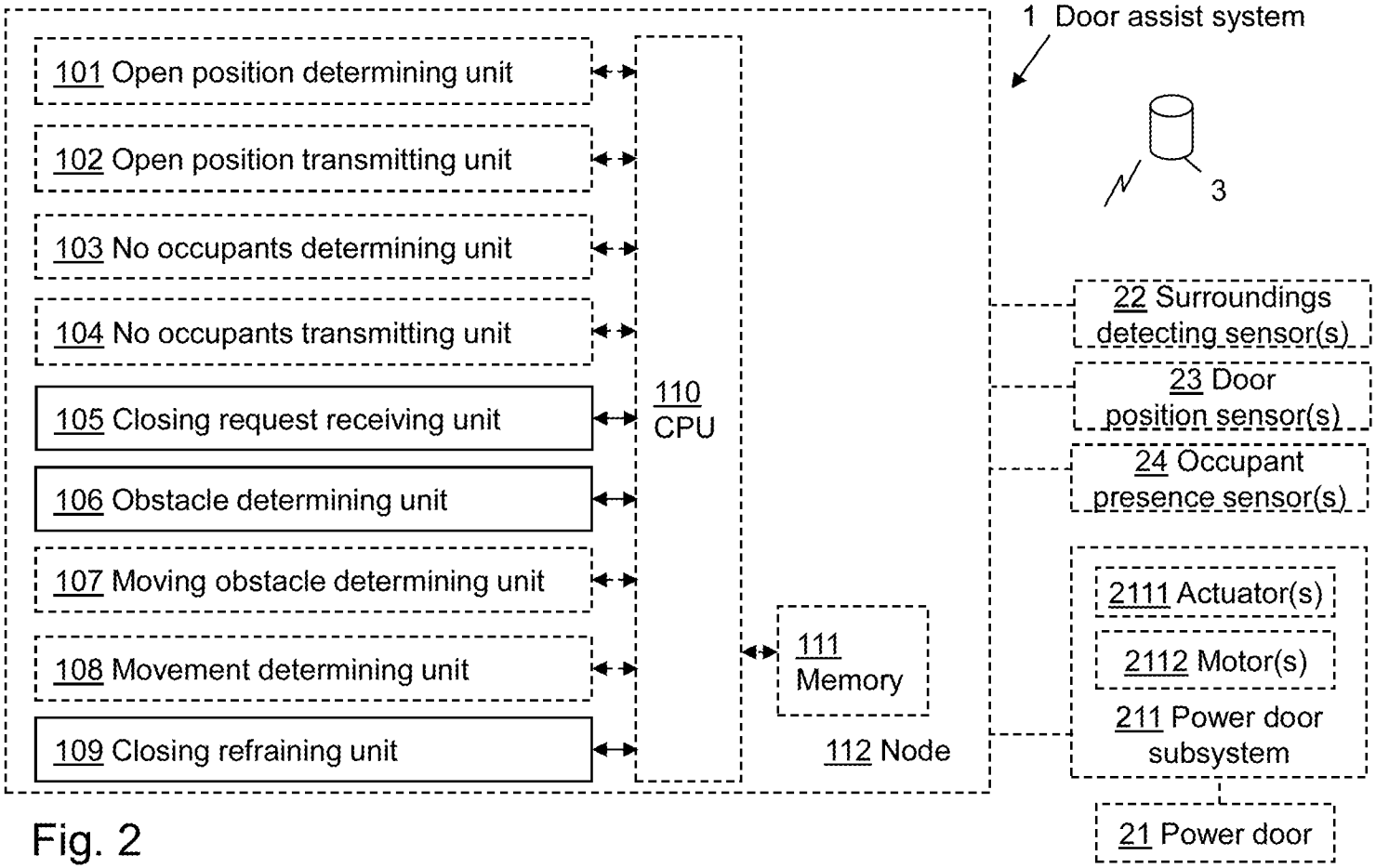
FIG. 2 is a schematic block diagram illustrating an exemplifying door assist system according to embodiments of the disclosure.

Optionally, the door assist system 1 may—by means of an optional open position determining unit 101 (shown in FIG. 2—be adapted for determining with input from one or more door position sensors 23 that a power door 21 of the vehicle 2 is in an open position 7. Thereby, it may be established with support from at least a first sensor 23 adapted for sensing and/or determining a door position status, that the power door 21 is deemed to be in an unclosed position 7. In other words, it may be determined whether the power door 21 is in an open position 7, rather than in a closed and/or semi-closed position. Subsequently, as a consequence of the unclosed 7 vehicle door 21, it may be derived that the vehicle 2, e.g. the driverless taxi, for instance may be unable to take off and/or a taxi service for a potential previous customer may be prevented from being deemed completed.

The open position 7 may be associated with and/or refer to an opening angle 70, for instance represented by an angle from a few degrees up to maximum angle at which the power door has reached its opening limit. Determining that the power door 21 is in an open position 7 may be accomplished as commonly known in the art, and accordingly, the one or more door position sensors 23 may refer to commonly known sensors adapted to determine and/or sense door position status and/or open door angle status. The one or more door status sensors 23 may be positioned in any arbitrary manner considered relevant to determine a door position status and/or open door angle status, and for instance be comprised in and/or be attached to the vehicle 2 and/or power door 21.

The expression "with input" from one or more door position sensors may refer to "with support" from one or more door position sensors, whereas "open" position may refer to "open angular" position, "unclosed" position and/or "unlatched" position. According to an example, "open position" may further refer to "open position with an opening angle exceeding a predetermined and/or predeterminable angle threshold e.g. represented by 5, 15 or 25 degrees". According to another example, the expression "that a power door of the vehicle is in an open position" may refer to "whether a power door of the vehicle is in an open position".

Optionally, the door assist system 1 may—by means of an optional open position transmitting unit 102 (shown in FIG. 2)—be adapted for transmitting to the off-board system 3 a door status signal 8 indicative of the open position 7 of the power door 21. Thereby, the door assist system 1 may inform the off-board system 3, which for instance may be part of a service centre for managing self-driving taxis, of that a power door 21 of the vehicle 2 is in an open state 7. Subsequently, the service centre may directly and/or indirectly be informed of that the vehicle 2, e.g. the driverless taxi, for instance may be unable to take off and/or a taxi service for a potential previous customer may be prevented from being deemed completed.

Communication between the door assist system 1 and the off-board system 3 may as previously indicated be accomplished as commonly known in the art, for instance by communicating wirelessly in a known manner.

The expression "transmitting" may refer to "transmitting wirelessly", "sending" and/or "pushing", and according to an example further to "subsequent a request from the off-board system transmitting". The expression door status "signal", on the other hand, may refer to door status "message", "information" and/or "warning", whereas "indicative of" the open position may refer to "comprising information of" the open position. According to an example, the expression "transmitting to the off-board system a door status signal indicative of the open position of the power door" may refer to "transmitting to the off-board system a door status signal indicative of the open position of the power door, when it is determined that the power door is in an open position".

Optionally, the door assist system 1 may—by means of an optional no occupants determining unit 103 (shown in FIG. 2)—be adapted for determining with input from one or more occupant presence sensors 24 that no occupants are on-board the vehicle 2. Thereby, it may be established with support from at least a first sensor 24 adapted for determining and/or sensing vehicle occupants presence within the vehicle 2, that it is deemed that the vehicle 2 is empty of occupants. In other words, it may be determined whether no passengers are on-board the vehicle 2. Subsequently, it may be derived that no one remains in the vehicle 2, e.g. the driverless taxi, to potentially manually close the open vehicle door 21.

Determining that there are no occupants on-board the vehicle 2 may be accomplished as commonly known in the art, and accordingly, the one or more occupant presence sensors 24 may refer to commonly known sensors adapted to determine and/or sense occupant presence, such as e.g. commonly known cameras and/or weight sensors. The one or more occupant presence sensors 24 may be positioned in any arbitrary manner considered relevant to determine and/or sense occupant presence within the vehicle 2, and for instance be comprised in and/or be attached to the vehicle 2 and/or e.g. vehicle seat(s).

The expression "with input" from one or more occupant presence sensors may refer to "with support" from one or more occupant presence sensors, whereas "no" occupants may refer to "zero" occupants. "Occupants", on the other hand, may refer to "passengers" and/or "humans", whereas "on-board" the vehicle may refer to "within" the vehicle. According to an example, the expression "that no occupants are on-board the vehicle" may refer to "whether no occupants are on-board the vehicle".

Optionally, the door assist system 1 may—by means of an optional no occupants transmitting unit 104 (shown in FIG. 2)—be adapted for transmitting to the off-board system 3 an occupant status signal 9 indicative of that no occupants are on-board the vehicle 2. Thereby, the door assist system 1 may inform the off-board system 3, which for instance may be part of a service centre for managing self-driving taxis, of that no passengers are on-board the vehicle 2. Subsequently, the service centre may directly and/or indirectly be informed of that no one remains in the vehicle 2, e.g. the driverless taxi, to potentially manually close the open vehicle door 21.

Communication between the door assist system 1 and the off-board system 3 may as previously indicated be accomplished as commonly known in the art, for instance by communicating wirelessly in a known manner.

The expression "transmitting" may as previously indicated refer to "transmitting wirelessly", "sending" and/or "pushing", and according to an example further to "subsequent a request from the off-board system transmitting". The expression occupant status "signal", on the other hand, may refer to occupant status "message", "information" and/or "warning", whereas "indicative of" that no occupants are on-board may refer to "comprising information of" that no occupants are on-board. According to an example, the expression "transmitting to the off-board system an occupant status signal indicative of that no occupants are on-board the vehicle" may refer to "transmitting to the off-board system an occupant status signal indicative of that no occupants are on-board the vehicle, when it is determined that no occupants are on-board the vehicle".

Optionally, the door assist system 1 may—by means of an optional moving obstacle determining unit 107 (shown in FIG. 2)—be adapted for determining that the obstacle 5 is moving, and further—by means of an optional movement determining unit 108 (shown in FIG. 2)—be adapted for determining a predicted movement 50 of the obstacle 5. The closing refraining unit 109 of the door assist system 1 may then be adapted for refraining from activating closing of the power door 21 when the predicted movement 50 of the obstacle 5 is determined to potentially interfere with a projected closing path 6 of the power door 21. Thereby, upon determining that a predicted movement 50 of moving obstacle 5 is expected to come in the way for the intended closing of the power door 21, the door assist system 1 may refrain from actuating the requested closing of said power door 21. In other words, a check may be carried out of whether a movement 50 of a detected moving obstacle 5 is predicted to potentially interfere with a projected closing path 6, and when that is the case, the—by the off-board system 3 requested—closing of the power door 21 is not actuated or alternatively held e.g. until it is determined that the predicted movement 50 of the moving obstacle 5 no longer is deemed to interfere with the projected closing path 6 of the power door 21. Thus, the risk of the power door 21 upon the requested closing potentially colliding with and/or hitting an obstacle 5 e.g. moving towards, near and/or around the vehicle 2, and/or the risk of pinching said moving obstacle 5 between the power door 21 and the vehicle 2, is thereby eliminated and/or at least reduced.

Determining that the obstacle 5 is moving may be accomplished as commonly known in the art, e.g. with support from the one or more surroundings detecting sensors 22. Determining a predicted movement 50 of the obstacle 5 may in a similar manner be accomplished as known in the art, e.g. by analysing how the obstacle 5 moves with input from the one or more surrounding detecting sensors 22 and therefrom derive a predicted movement 50. Determining that the predicted movement 50 of the obstacle 5 is deemed to interfere with the projected closing path 6, on the other hand, may be accomplished e.g. by comparing the predicted movement 50 with the projected closing path 6.

The expression that the obstacle is "moving" may refer to that the obstacle is "moving in a horizontal plane and/or in a plane parallel to the ground" and/or to that the obstacle is "moving at least partly towards, near and/or around the vehicle". "Determining a predicted" movement of the obstacle, on the other hand, may refer to "predicting an expected" movement of the obstacle, whereas "a predicted movement" may refer to "an expected movement". "A predicted movement" of the obstacle may further refer to "at least a first predicted upcoming position" of the obstacle, whereas the expression "determined to potentially interfere" with a projected closing path of the power door may refer to "predicted to interfere" with a projected closing path of the power door. According to an example, the expression "determining that the obstacle is moving" may refer to "determining whether the obstacle is moving". In a similar manner, according to another example, the expression "when the predicted movement of the obstacle is determined to potentially interfere with a projected closing path of the power door" may refer to "when it is determined that the object is moving and the predicted movement of the obstacle is determined to potentially interfere with a projected closing path of the power door".

According to one example, the expression "refraining from activating closing of the power door when predicted movement of the obstacle is determined to potentially interfere with a projected closing path of the power door" may refer to "refraining from activating closing of the power door when predicted movement of the obstacle is determined to potentially interfere with a projected closing path of the power door as the power door moves from an open position to a closed position". According to another example, the expression "refraining from activating closing of the power door when predicted movement of the obstacle is determined to potentially interfere with a projected closing path of the power door" may refer to "refraining from activating closing of the power door when predicted movement of the obstacle is determined to potentially interfere with a projected closing path of the power door, and otherwise activating closing of the power door". According to yet another example, the expression "refraining from activating closing of the power door when predicted movement of the obstacle is determined to potentially interfere with a projected closing path of the power door" may refer to "refraining from activating closing of the power door when predicted movement of the obstacle is determined to potentially interfere with a projected closing path of the power door, until it is determined that the predicted movement of the obstacle no longer potentially interferes with the projected closing path of the power door".

Optionally, the closing refraining unit 109 may further be adapted for refraining from activating closing of the power door 21 when the predicted movement 50 of the obstacle 5 is determined to potentially interfere with a projected closing path 6 of the power door 21 during a predeterminable time interval. Thereby, the door assist system 1 may refrain from actuating the requested closing of said power door 21 upon determining that a predicted movement 50 of moving obstacle 5 is expected to come in the way for the intended closing of the power door 21 during a specific period of time, e.g. during the actual closing of the door 21. In other words, a check may be carried out of whether a movement 50 of a detected moving obstacle 5 is predicted to potentially interfere with a projected closing path 6 during the specific time interval, and only when the potential interference occurs within said time interval is the—by the off-board system 3 requested—closing of the power door 21 not actuated, and/or alternatively held e.g. until it is determined that the moving obstacle's 5 predicted movement 50 no longer is deemed to interfere with the power door's 21 projected closing path 6 during said time interval. Thus, the conditions under which the activation of closing the power door 21 is refrained may be less strict, and not apply when potential interference of the obstacle's 5 predicted movement 50 with the power door's 21 projected closing path 6 is determined and/or predicted to occur outside of the predetermined time interval, such as for instance outside the actual closing of the power door 21. According to an example, the conditions under which the activation of closing the power door 21 is refrained would then not apply for instance when the moving object 5 is predicted to not have yet reached the predicted closing path 6 before closing of the power door 21 is estimated to be finalized.

The predeterminable time interval may be arbitrarily selected, and may for instance represent the expected time interval for closing the power door 21 and/or until said closing is finalized, further for instance with arbitrarily selected extra time added e.g. to provide safety margins. The duration of, the start of and/or the end of the time interval may accordingly be arbitrarily selected, e.g. in consideration of when closing of the power door 21 is determined and/or expected to be actuated and/or finalized. The time interval may further vary with how widely open the power door 21 is determined to be, thus for instance vary with the opening angle 70 thereof 21. Moreover, the time interval may for instance range from less than a second up to several seconds or even tens of seconds.

The expression "during" a predeterminable time interval may refer to "at least partly coinciding" with a predeterminable time interval, whereas "predeterminable" may refer to "predetermined", "selectable" and/or "specific" time interval. "A predeterminable time interval", on the other hand, may according to an example refer to "the expected closing of the vehicle door".

According to an example, the expression "refraining from activating closing of the power door when predicted movement of the obstacle is determined to potentially interfere with a projected closing path of the power door during a predeterminable time interval" may refer to "refraining from activating closing of the power door when predicted movement of the obstacle is determined to during a predeterminable time interval potentially interfere with a projected closing path of the power door as the power door moves from an open position to a closed position". According to another example, the expression "refraining from activating closing of the power door when predicted movement of the obstacle is determined to potentially interfere with a projected closing path of the power door during a predeterminable time interval" may refer to "refraining from activating closing of the power door when predicted movement of the obstacle is determined to potentially interfere with a projected closing path of the power door during a predeterminable time interval, and otherwise activating closing of the power door". According to yet another example, the expression "refraining from activating closing of the power door when predicted movement of the obstacle is determined to potentially interfere with a projected closing path of the power door during a predeterminable time interval" may refer to "refraining from activating closing of the power door when predicted movement of the obstacle is determined to potentially interfere with a projected closing path of the power door during a predeterminable time interval, until it is determined that the predicted movement of the obstacle no longer potentially interferes with the projected closing path of the power door".

As further shown in FIG. 2, which is a schematic block diagram illustrating an exemplifying door assist system 1 according to embodiments of the disclosure, the door assist system 1 comprises as indicating in conjunction with FIG. 1 an optional open position determining unit 101, an optional open position transmitting unit 102, an optional no occupants determining unit 103, an optional no occupants transmitting unit 104, a closing request receiving unit 105, an obstacle determining unit 106, an optional moving obstacle determining unit 107, an optional movement determining unit 108, and a closing refraining unit 109, all of which were described in greater detail in conjunction with FIG. 1. Furthermore, the embodiments herein for handling of remotely triggered operation of a power door 21 of a vehicle 2, may be implemented through one or more processors, such as a processor 110, here denoted CPU, together with computer program code for performing the functions and actions of the embodiments herein. Said program code may also be provided as a computer program product, for instance in the form of a data carrier carrying computer program code for performing the embodiments herein when being loaded into the door assist system 1. One such carrier may be in the form of a CD ROM disc and/or a hard drive. It is however feasible with other data carriers such as a memory stick. The computer program code may furthermore be provided as pure program code on a server and downloaded to the door assist system 1. The door assist system 1 may further comprise a memory 111 comprising one or more memory units. The memory 111 may be arranged to be used to store e.g. information, and further to store data, configurations, schedulings, and applications, to perform the methods herein when being executed in the door assist system 1. For instance, the computer program code may be implemented in the firmware, stored in FLASH memory 111, of an embedded processor 110, and/or downloaded from online.

Furthermore, the optional open position determining unit 101, the optional open position transmitting unit 102, the optional no occupants determining unit 103, the optional no occupants transmitting unit 104, the closing request receiving unit 105, the obstacle determining unit 106, the optional moving obstacle determining unit 107, the optional movement determining unit 108, the closing refraining unit 109, the optional processor 110 and/or the optional memory 111, may at least partly be comprised in one or more nodes 112 e.g. ECUs of the vehicle 2. Those skilled in the art will also appreciate that said units 101, 102, 103, 104, 105, 106, 107, 108, 109 described above may refer to a combination of analog and digital circuits, and/or one or more processors configured with software and/or firmware, e.g. stored in a memory such as the memory 111, that when executed by the one or more processors such as the processor 110 perform as was described in conjunction with FIG. 1 and as will be described in more detail in conjunction with FIG. 3. One or more of these processors, as well as the other digital hardware, may be included in a single ASIC (Application-Specific Integrated Circuitry), or several processors and various digital hardware may be distributed among several separate components, whether individually packaged or assembled into a SoC (System-on-a-Chip).

Further shown in FIG. 2 is optional off-board system 3, optional one or more surroundings detecting sensors 22, optional one or more door position sensors 23, optional one or more occupant presence sensors 24, optional power door 21, optional power door subsystem 211 comprising optional one or more actuators 2111 and/or comprising optional one or more motors 2112, all of which were described in greater detail in conjunction with FIG. 1.

Figure 3:
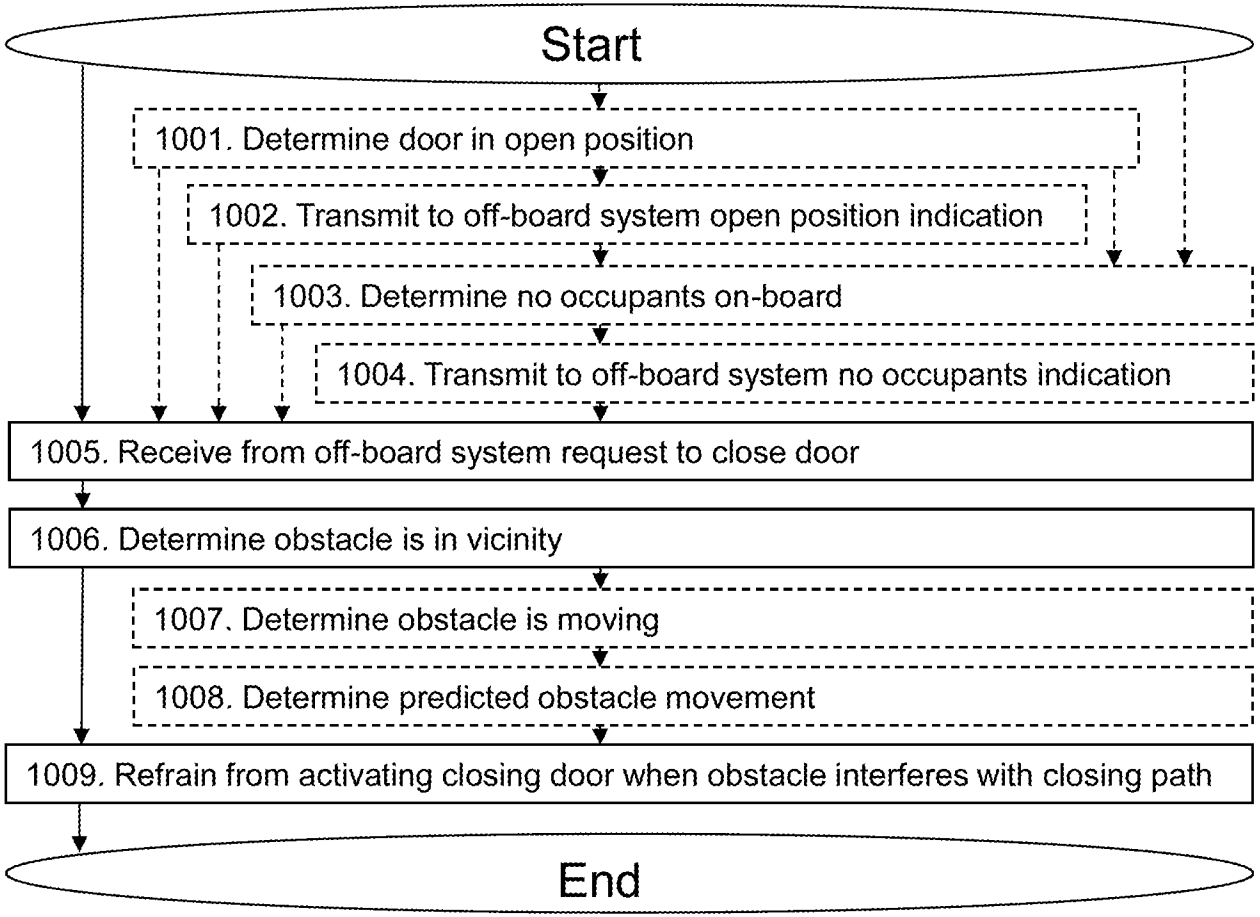
FIG. 3 is a flowchart depicting an exemplifying method performed by a door assist system according to embodiments of the disclosure.

FIG. 3 is a flowchart depicting an exemplifying method performed by a door assist system 1 according to embodiments of the disclosure. Said method is for handling of remotely triggered operation of a power door 21 of a vehicle 2. The exemplifying method, which may be continuously repeated, comprises the following actions discussed with support from FIGS. 1-2. Moreover, the actions may be taken in any suitable order and/or one or more actions may be performed simultaneously and/or in alternate order where applicable; for instance, Action 1003 may be performed simultaneously with and/or prior to Action 1001, and/or Action 1005 may be performed simultaneously with and/or prior to Action 1001 or Action 1003. Moreover, according to an example, Actions 1006 and 1009 may be repeatedly iterated.

Action 1001

In optional Action 1001, the door assist system 1 may determine with input from one or more door position sensors 23—e.g. with support from the open position determining unit 101—that a power door 21 of the vehicle is in an open position 7.

Action 1002

In optional Action 1002, which may follow upon optional Action 1001, the door assist system 1 may transmit to the off-board system 3—e.g. with support from the open position transmitting unit 102—a door status signal 8 indicative of the open position 7 of the power door 21.

Action 1003

In optional Action 1003, the door assist system 1 may determine with input from one or more occupant presence sensors 24—e.g. with support from the no occupants determining unit 103—that no occupants are on-board the vehicle 2.

Action 1004

In optional Action 1004, which may follow upon optional Action 1003, the door assist system 1 may transmit to the off-board system 3—e.g. with support from the no occupants transmitting unit 104—an occupant status signal 9 indicative of that no occupants are on-board the vehicle 2.

Action 1005

In Action 1005, the door assist system 1 receives from the off-board system 3—e.g. with support from the closing request receiving unit 105—a door closure signal 4 requesting the door assist system 1 to activate closing of a power door 21 of the vehicle 2.

Action 1006

In Action 1006, e.g. with support from the obstacle determining unit 106, the door assist system 1 determines with input from one or more surroundings detecting sensors 22 adapted to capture a surrounding proximate the vehicle 2, that an obstacle 5 is in vicinity of the vehicle 2.

Action 1007

In optional Action 1007, the door assist system 1 may determine—e.g. with support from the moving obstacle determining unit 107—that the obstacle 5 is moving.

Action 1008

In optional Action 1008, which may follow upon optional Action 1007, the door assist system 1 may determine—e.g. with support from the movement determining unit 108—a predicted movement 50 of the obstacle 5.

Action 1009

In Action 1009, e.g. with support from the closing refraining unit 109, the door assist system 1 refrains from activating closing of the power door 21 when the obstacle 5 is determined to interfere and/or potentially interfere with a projected closing path 6 of the power door 21.

Optionally, following upon optional Actions 1007 and 1008, Action 1009 may comprise refraining from activating closing of the power door 21 when the predicted movement 50 of the obstacle 5 is determined to potentially interfere with a projected closing path 6 of the power door 21.

Furthermore, optionally, following upon optional Actions 1007 and 1008, Action 1009 may comprise refraining from activating closing of the power door 21 when the predicted movement 50 of the obstacle is determined to potentially interfere with a projected closing path 6 of the power door 21 during a predeterminable time interval.

The person skilled in the art realizes that the present disclosure by no means is limited to the preferred embodiments described above. On the contrary, many modifications and variations are possible within the scope of the appended claims. It should furthermore be noted that the drawings not necessarily are to scale and the dimensions of certain features may have been exaggerated for the sake of clarity. Emphasis is instead placed upon illustrating the principle of the embodiments herein. Additionally, in the claims, the word "comprising" does not exclude other elements or steps, and the indefinite article "a" or "an" does not exclude a plurality.

The invention claimed is:

1. A method performed by a door assist system of a vehicle for handling of remotely triggered operation of a power door of the vehicle, the method comprising:

receiving, by a closing request receiving unit, from an off-board system a door closure signal requesting the door assist system to activate closing of a power door of the vehicle;

determining with input from one or more occupant presence sensors that no occupants are on-board the vehicle;

determining, by an obstacle determining unit, with input from one or more surroundings detecting sensors adapted to capture a surrounding proximate the vehicle, that an obstacle is in vicinity of the vehicle; and responsive to determining that the obstacle will interfere or potentially interfere with a projected closing path of the power door, refraining, by a closing refraining unit, from activating closing of the power door.

2. The method according to claim 1, further comprising:

determining with input from one or more door position sensors that a power door of the vehicle is in an open position.

3. The method according to claim 2, further comprising:

transmitting to the off-board system a door status signal indicative of the open position of the power door.

4. The method according to claim 1, further comprising:

transmitting to the off-board system an occupant status signal indicative of that no occupants are on-board the vehicle.

5. The method according to claim 1, further comprising:

determining that the obstacle is moving; and determining a predicted movement of the obstacle;

wherein the refraining from activating closing of the power door then comprises refraining from activating closing of the power door responsive to determining that the predicted movement of the obstacle will potentially interfere with a projected closing path of the power door.

6. The method according to claim 5, wherein the refraining from activating closing of the power door comprises refraining from activating closing of the power door responsive to determining that the predicted movement of the obstacle will potentially interfere with a projected closing path of the power door during a predeterminable time interval.

7. The method according to claim 1, wherein the refraining from activating closing of the power door comprises refraining from closing of the power door responsive to determining that the obstacle will interfere or potentially interfere with a projected closing path of the power door, and otherwise activating closing of the power door.

8. The method according to claim 1, wherein the refraining from activating closing of the power door comprises refraining from closing of the power door responsive to determining that the obstacle will interfere or potentially interfere with a projected closing path of the power door, until it is determined that the obstacle no longer interferes and/or potentially interferes with the projected closing path of the power door.

* * * * *